US007686170B2

(12) United States Patent
Palmer

(10) Patent No.: US 7,686,170 B2
(45) Date of Patent: Mar. 30, 2010

(54) DEFLECTOR FOR SPIRAL SEPARATOR, AND METHOD OF SPIRAL SEPARATION

(75) Inventor: Mark Kenneth Palmer, Benowa (AU)

(73) Assignee: EDI Rail Pty Ltd (AU)

( * ) Notice: Subject to any disclaimer, the term of this patent is extended or adjusted under 35 U.S.C. 154(b) by 0 days.

(21) Appl. No.: 11/401,553

(22) Filed: Apr. 11, 2006

(65) Prior Publication Data

US 2006/0180508 A1 Aug. 17, 2006

Related U.S. Application Data

(63) Continuation of application No. 10/478,043, filed as application No. PCT/AU02/00602 on May 17, 2002, now abandoned.

(51) Int. Cl.
*B07B 1/08* (2006.01)
*B07B 11/00* (2006.01)
*B03B 5/00* (2006.01)

(52) U.S. Cl. ..... 209/362; 209/459; 209/493; 209/697

(58) Field of Classification Search ..... 209/362, 209/434, 459, 493, 497, 697
See application file for complete search history.

(56) References Cited

U.S. PATENT DOCUMENTS 5,452,805 A 9/1995 Robertson et al.
6,264,041 B1 7/2001 Niitti

FOREIGN PATENT DOCUMENTS

AU 2542057 1/1958
AU 71630 A1 5/2001
EP 123501 A1 * 10/1984

* cited by examiner

*Primary Examiner*—Patrick H Mackey
*Assistant Examiner*—Mark Hageman
(74) *Attorney, Agent, or Firm*—Tucker Ellis & West, LLP

(57) ABSTRACT

A deflector (1) for attachment to a spiral separator (2), for capturing and redirecting a portion of a flowing stream of material (5). The deflector (1) includes an attachment means (3), to attach the deflector (1) to the spiral separator (2), a capturing portion (4) to capture a portion of the flowing stream (5), and, a redirecting portion (6) to emit a portion (7) of the stream. A method of separating particles of different densities using the deflector device (1) in conjunction with a spiral separator (2) is also disclosed.

18 Claims, 2 Drawing Sheets

DEFLECTOR FOR SPIRAL SEPARATOR, AND METHOD OF SPIRAL SEPARATION

This application is a continuation of U.S. patent application Ser. No. 10/478,043, filed Jun. 7, 2004 now abandoned, which claims priority of PCT Patent Application No. PCT/AU02/00602, filed May 17, 2002.

BACKGROUND OF THE INVENTION

The present invention relates to a spiral separator and to a method of spiral separation, and in particular, to a deflector to use in a spiral separator and method of spiral separation. In particular, the present invention relates to the use of such a deflector for the improved separation of particles of different densities.

DESCRIPTION OF THE PRIOR ART

The reference to any prior art in this specification is not, and should not be taken as, an acknowledgement or any form of suggestion that that prior art forms part of the common general knowledge in Australia.

Spiral separators are extensively used for the wet gravity separation of solids 15 according to their specific gravity, for example, for separating various kinds of mineral sands from silica sands.

Separators of the kind under discussion are shown, for example, in the Applicant's Australian Patent No. 552425 (82717/82). Such separators commonly include a vertical column about which there are supported one or more helical troughs. ill operation, a "pulp" or slurry of the materials to be separated and water is introduced to the upper end of a trough and, as the pulp descends the helix, centrifugal forces act on the dense particles in a radially outwards direction while the more dense particles segregate to the bottom of the flow, and after slowing, through close approach to the working surface of the trough, gravitate towards the vertical column.

During operation of a spiral separator there is a general migration of water from the inner portion or smaller radius of the flow to the outer portion of the flow. However, particularly when there are high proportions of high specific gravity particles present in the pulp, the total water supply at the inner portion can be used up before segregation is completed. As this takes place there is an accumulation of particles at the inner portion which, while it does not prevent the stream from continuing to move, changes the effective shape of the volute cross section and separation proceeds no further.

To improve on the operation of such spiral separators, a deflector has been previously developed by the Applicants of the present invention, as described in Australian Patent Serial No. 575046 (27077/84). In that specification, there is described a spiral separator characterized by the inclusion of at least one deflector located adjacent an outer edge of the spiral separator, the deflector having a contoured upper surface to receive and deflect a portion of the low solids, high velocity, stream component in a fan like spray from the outer edge of the pulp stream back across the stream towards the inner edge. In particular, that device interrupts a portion of low density, high water content, stream from the 'tailing zone' and sprays or redeposits it into the high density, low water content, 'middling zone'.

Whilst the deflector of Australian Patent Serial No. 575046 improved the recovery of minerals, due to the inability for the device to be readily adjusted, and due to its somewhat inflexible design, the deflector device has been found to be somewhat limited, identifying a need for an improved product thereto.

SUMMARY OF THE INVENTION

The present invention seeks to provide a deflector device which seeks to overcome at least some of the disadvantages of the prior art deflector devices, including that described in Australian Patent Serial No. 575046 (27077/84).

The present invention seeks to provide a deflector device which has a more refined action and has much greater scope for influencing the stream in a spiral separation, to enhance separation.

In one broad form, the present invention provides a deflector adapted to be attached to a spiral separator for capturing and redirecting a controlled portion of a flowing stream 25 of material flowing through said spiral separator, said deflector including:

attachment means, for attachment of said deflector to said spiral separator;

a capturing portion, shaped to substantially ride atop and capture a portion of said flowing stream of material; and, a redirecting portion, integrally formed with said capturing portion, shaped to emit 30 said portion of said stream of material captured by said capturing portion.

Preferably, said attachment means includes an arm member, to permit substantially resilient and/or pivotal movement of said deflector connected to said spiral separator.

Also preferably, said arm member includes anyone or combination of a pivoting arm, a flexible arm, a string, line, flap, magnetic field or any other mechanical means.

Most preferably, said capturing portion captures the 'tailing' portion of said flowing stream of material from an outer region of the trough of the spiral separator.

Also most preferably; said redirecting portion redirects said captured material into the 'middlings' portion of the flowing stream.

Also preferably, said redirecting portion redirects said captured material into said flow stream in a patterned spray.

In a preferred form, said patterned spray is in a 'fan-like' shape, a substantially hemispherical shape, or other thin broad canopy of spray that re-enters the main stream substantially in an arc about the head of the reflector.

Alternatively, but also preferably, said redirecting portion redirects said captured material to another device such as, but not limited to, a gallery or distributor to administer the water in a controlled manner.

Preferably, said deflector is formed to function in a substantially buoyant manner. Also preferably, said deflector is at least partly formed from substantially buoyant material.

Also preferably, said device substantially rides on or aquaplanes on the surface of said stream.

Also preferably, said device is weighted or tensioned for heavier action (heavier fan) or unweighted for lighter action by adjusting the flexibility, weight, tension and/or tightness of the arm member or the like.

Preferably also, said device may be twisted or pivotally adjusted to enable adjustment of the rate and/or other characteristics of the emission of the captured material.

Also preferably, said arm member is lengthened or shortened to change the angle and/or weighting with which the capturing portion penetrates the stream.

In a further broad form, the present invention provides a spiral separator adapted to receive a flowing stream of water and particulate material at an upper end thereof, to separate particles of different densities as the stream moves downwardly therethrough, said separator including at least one deflector therein to capture and redirect a portion of said material flowing adjacent to an outer edge of said separator, said deflector including:

attachment means, for attachment of said deflector to said spiral separator;

a capturing portion, shaped to substantially ride atop and capture a portion of said flowing stream of material; and, a redirecting portion, integrally formed with said capturing portion, shaped to emit said portion of said stream of material captured by said capturing portion.

In yet a further broad form, the present invention provides a method of separating particles of different densities using a spiral separator including a deflector, substantially as herein described.

BRIEF DESCRIPTION OF THE DRAWINGS

The present invention will become more fully understood from the following detailed description of preferred but non-limiting embodiments thereof, described in connection with the accompanying drawings, wherein.

DETAILED DESCRIPTION OF PREFERRED EMBODIMENTS

Figure 1:
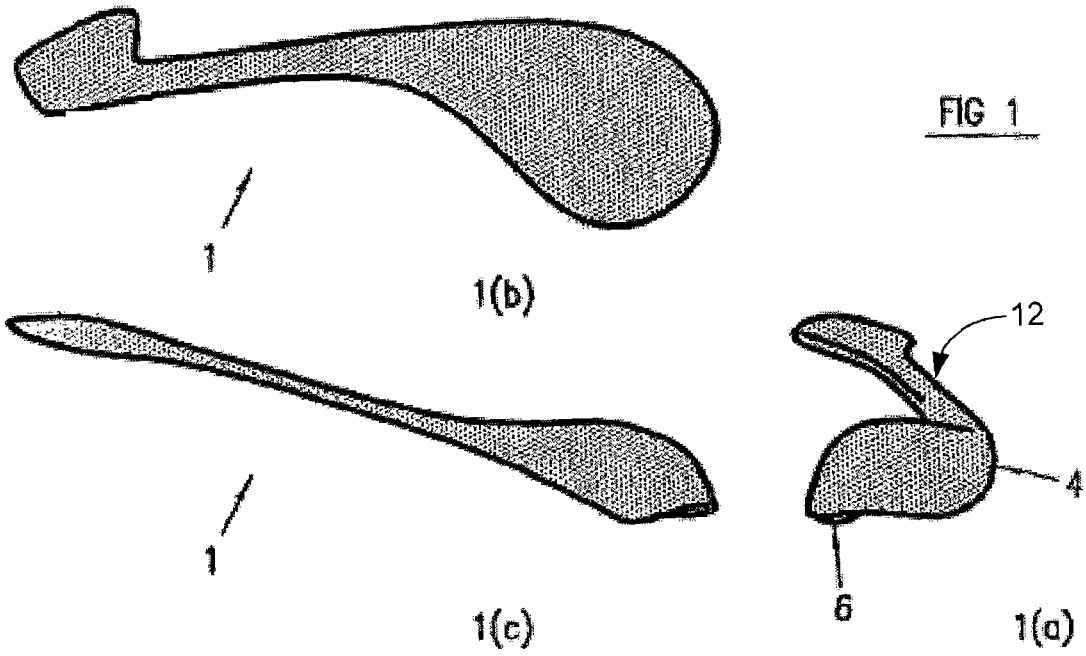
FIG. 1 illustrates sketches of a deflector device in accordance with the present invention, showing front, plan and side views in FIGS. 1(*a*), 1(*b*) and 1(*c*), respectively.
Figure 2:
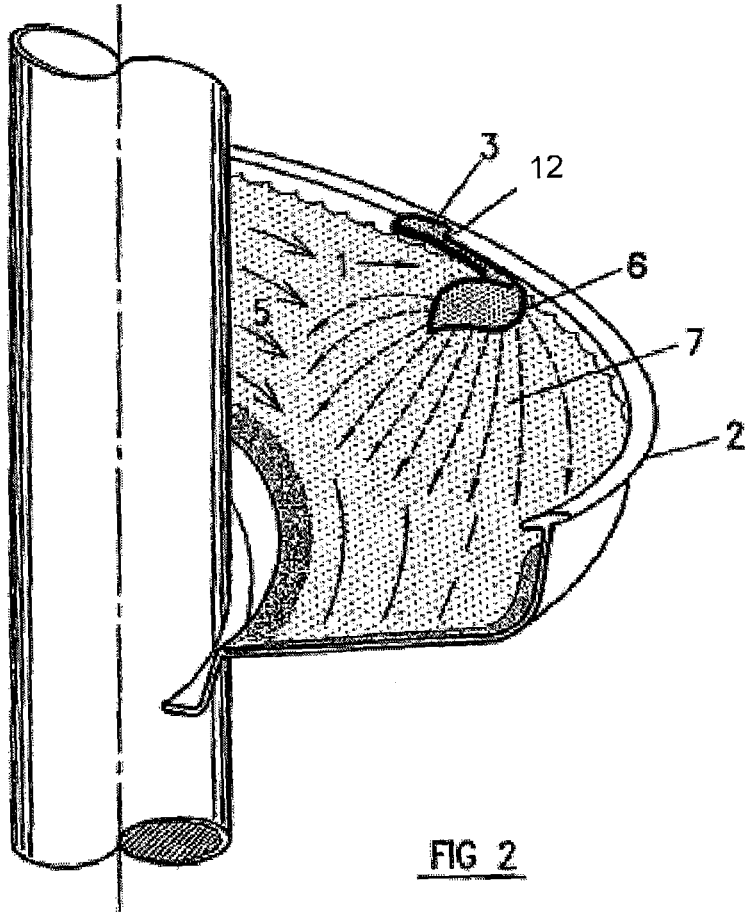
FIG. 2 illustrates the deflector device attached to a spiral separator in accordance with the present invention; and, FIG. 3 illustrates top, sectional and end views of the deflector shown attached to the spiral separator, in FIGS. 3(*a*), 3(*b*) and 3(*c*), respectively.

Throughout the drawings, like numerals will be used to identify similar features, except where expressly otherwise indicated.

As shown in the drawings, the deflector, generally designated by the numeral I, is adapted to be attached to a spiral separator, generally designated by the numeral 2. The deflector 1 is designed to capture and redirect a controlled portion of the flowing stream of material flowing through the spiral separator. The deflector 1, generally includes an attachment means 3, for attachment of the deflector 1 to the spiral separator 2, a capturing portion 4 shaped to substantially ride atop and capture a portion of the flowing stream of material 5, and a redirecting portion 6, which is integrally formed with the capturing portion 4, and which is shaped to spray or otherwise emit the captured material, as illustrated by reference numeral 7. The spray 7 may be patterned to be of any desired shape, depending upon the desired pattern of the spray as it re-enters the main stream. For example, the spray may be fan-shaped, substantially hemispherical in shape, or any other thin broad canopy of spray such that it re-enters the main stream-substantially in an arc about the head of the reflector.

Other than the attachment means 3 being used to affix the deflector 1 to the side of the spiral separator 2, the attachment means 3 may incorporate an arm member 12, to permit substantially resilient and/or pivotal movement of the deflector 1 when connected to the spiral separator 2. The arm member 12 may include anyone or combination of a pivoting arm, a flexible arm, a string, line, flap, magnetic field, or any other mechanical means. Other forms of arm member may alternatively become apparent to persons skilled in the art and should be considered to be encompassed within the scope of this invention.

The capturing portion 4 of the deflector 1, is shown in the drawings as capturing the "tailings" portion of the flowing stream of material 5 from an outer region ill of the trough 11 of the spiral separator 2.

Figure 3:
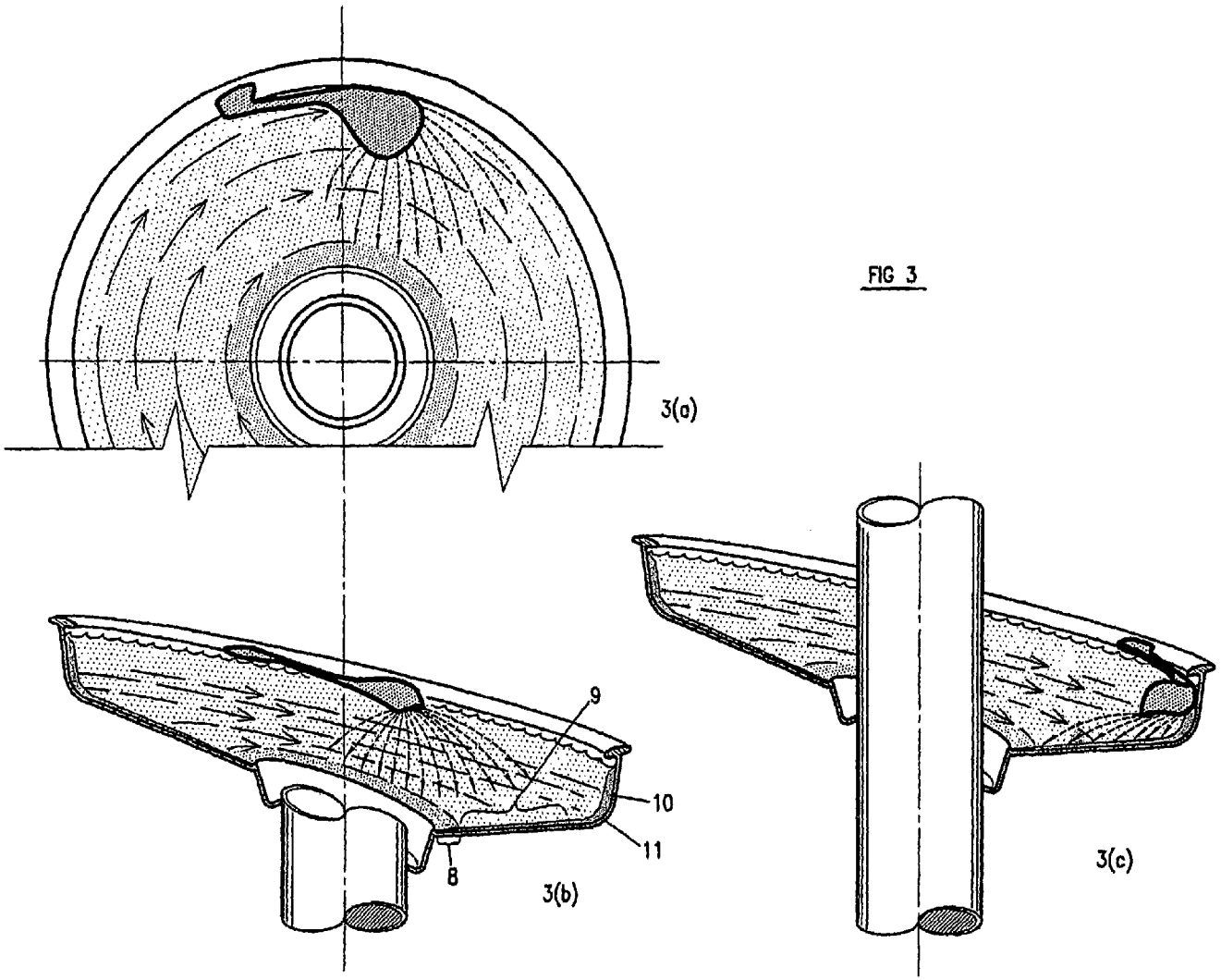

As will be understood by persons skilled in the art, and as shown in FIG. 3(*b*), spiral separators are generally used to recover minerals, and function by separating materials in to three generally known streams, including the 'concentrate' 8 found at the inner edge of the trough 11 of a spiral separator 2 and which is formed of particles of higher specific gravity, a 'tailing' stream 10 which is found towards the outer part of the trough 11 being the particles of lower specific gravity, and the 'middlings' stream 9 which is found intermediate the concentrate and tailings in the central transition zone.

As such, it will be appreciated that the deflector 1 shown in the drawings, redirects the portion of the material from the 'tailings' stream 10 in to the 'middlings' 9 portion of the flowing stream 5. It is also shown in the drawings that this is redirected in a fan like spray manner.

By redirecting the material in this manner, the 'middlings' 9 stream is exposed to two gentle influences, firstly as it enters the fan upstream, and again when it emerges downstream. Such an effect provides a significant performance enhancement of the spiral separator.

In an alternative arrangement, the redirecting portion, could redirect the captured material to another device (not shown), such as, but not limited to, a gallery or distributor to administer the water in a controlled manner.

The deflector device 2 of the present invention may either be at least partly formed from substantially buoyant material and/or, can be shaped to function in a substantially buoyant manner, then being formed of any desirable material. The device may be weighted or tensioned for heavier action (heavier fan), or unweighted for lighter action by adjusting the flexibility, weight, tension or tightness of the arm member portion of the device, or by other means. Depending on the particular amount of capture desired, these attributes can be selectively varied such that it either substantially 'rides' or 'aquaplanes' the surface of the stream due to the pressure, velocity of the liquid, or, it can be submerged to a greater or lesser extent.

The device may also be twisted or pivotally adjusted to enable adjustment of the rate and/or format of the emission of the captured material.

The arm member may also be lengthened or shortened to change the angle and/or the weighting in which the capturing portion penetrates the stream.

It will be appreciated that the present invention therefore provides a deflector device which is novel and inventive over the known prior art, including the Applicant's prior Australian Patent No. 575046 (27077/84). The differences and advantages of the device of the present invention is at least partially due to the freedom of movement of the device, whereby the head of the device floats or "rides" on top of the 'tailing' stream where it captures and redirects a controlled quantity of the flow in to another region of the trough. As described, usually, the redirected flow would typically take the form of a gentle fan or other patterned spray, and the fan or spray is usually directed in to the 'middlings' stream.

The head of the device is buoyant, created either by the material and/or by hydraulic pressure, to remain skimming the surface of the stream regardless of the flow rate of the spiral feed. The deflector therefore always remains in position for optimal performance. When the flow rate on a spiral increased, the stream at the outer wall rises. This causes conventional deflectors with fixed position, such as described in the Applicant's earlier Australian Patent No. 575046 (27077/84) to become more violent in its action, causing excessive disruption of the flow. When the flow rate on a spiral decreased, the level of the stream falls. This reduces the influence of prior art deflectors, and in some cases, the stream may fall completely below the point where the deflector is attached.

It will be appreciated that numerous variations and modifications may be envisaged by persons skilled in the art to the device hereinbefore described. All such variations and modifications should be considered to fall within the scope of the invention as broadly herein described and as hereinafter claimed.

The invention claimed is:

1. A deflector adapted to attach to an associated spiral separator having a trough through which material flows and to capture and redirect at least a portion of a flowing stream of material flowing through the spiral separator, said deflector comprising:

a capturing portion configured to substantially ride atop a surface of the flowing stream of material and capture at least a portion of the flowing stream of material wherein the capturing portion aquaplanes the surface of the flowing stream of material over a range of operational flow rates of the flowing stream of material in the trough; and a redirecting portion integrally formed with the capturing portion, configured to emit the portion of the stream of material captured by the capturing portion.

2. The deflector according to claim 1, further including an arm member, to attach said deflector to said spiral separator while permitting movement of the deflector relative thereto.

3. The deflector according to claim 2 wherein the arm member is a flexible arm.

4. The deflector according to claim 1 wherein the capturing portion is adapted to capture a tailing portion of the flowing stream of material from an outer region of the trough of the spiral separator.

5. The deflector according to claim 1 wherein the redirecting portion redirects the captured material into a middling portion of the flowing stream.

6. The deflector according to claim 1 wherein the redirecting portion redirects the captured material into flow stream in a patterned spray.

7. The deflector according to claim 6 wherein the patterned spray is in the shape of at least one of a fan, a substantially hemispherical shape, and thin broad canopy.

8. The deflector according to claim 1 wherein the redirecting portion redirects the capture material to an associated device.

9. The deflector according to claim 1 wherein the deflector is formed of substantially buoyant material.

10. The deflector according to claim 1 wherein the deflector is comprised of a substantially buoyant material.

11. The deflector according to claim 1 wherein the deflector is located substantially atop the surface of the flowing stream.

12. The deflector according to claim 1 wherein the deflector further comprises adjustment means adapted to adjust the location of the deflector in the flowing stream.

13. The deflector according to claim 12 wherein the adjustment means further adjust at least one of rate and format of the emission of the captured material.

14. A spiral separator adapted to receive a flowing stream of water and particulate material at an upper end thereof, to separate particles of different densities as the stream moves downwardly therethrough, comprising:

at least one deflector to capture and redirect at least a portion of a flowing stream of material flowing through the spiral separator, each deflector including:

a capturing portion, configured to substantially ride atop a surface of the flowing stream of material and capture at least a portion of the flowing stream of material wherein the capturing portion aquaplanes the surface of the flowing stream of material over a range of operational flow rates of the flowing stream of material in the trough; and a redirecting portion integrally formed with the capturing portion, configured to emit the portion of the stream of material captured by the capturing portion.

15. A deflector adapted to attach to an associated spiral separator having a trough through which material flows and to capture and redirect at least a portion of a flowing stream of material flowing through the spiral separator, said deflector comprising:

an arm member adapted to allow movement of the deflector during use of the deflector when attached to the associated spiral separator;

a capturing portion configured to capture a portion of the flowing stream of material and substantially aquaplane on a surface of the flowing stream of material over a range of operational flow rates of the flowing stream of material in the trough; and, a redirecting portion integrally formed with the capturing portion and configured to emit the portion of the stream of material captured by the capturing portion.

16. The deflector according to claim 15 wherein:

the arm member is configured to allow resilient movement of the deflector during use of the deflector when attached to the associated spiral separator.

17. The deflector according to claim 15 wherein:

the arm member is configured to allow pivotal movement of the deflector during use of the deflector when attached to the associated spiral separator.

18. The deflector according to claim 15 wherein the deflector is at least partially formed of a substantially buoyant material.

* * * * *